US005941489A

United States Patent [19]

Fanelli et al.

[11] Patent Number: 5,941,489

[45] Date of Patent: Aug. 24, 1999

[54] REVERSIBLE T-RAIL MOUNTABLE TO A PICATINNY RAIL

[75] Inventors: Salvatore A Fanelli, Columbia; Harold L Miller, Lugoff; George E. Kontis, Columbia, all of S.C.

[73] Assignee: FN Manufacturing Inc., Columbia, S.C.

[21] Appl. No.: 08/923,135

[22] Filed: Sep. 4, 1997

[51] Int. Cl.[6] ..... A47F 5/00

[52] U.S. Cl. ..... 248/298.1; 33/245; 42/101

[58] Field of Search ..... 248/298.1, 265, 248/269, 259, 260, 292.12, 423; 42/100, 101; 33/248, 261

[56] References Cited

U.S. PATENT DOCUMENTS

| | | | |
|---|---|---|---|
| 2,583,260 | 1/1952 | Felix | 33/245 |
| 3,750,318 | 8/1973 | Burris | 42/1 S |
| 4,021,954 | 5/1977 | Crawford | 42/1 ST |
| 4,383,371 | 5/1983 | Coffey | 33/245 |
| 4,742,636 | 5/1988 | Swan | 42/101 |
| 5,086,566 | 2/1992 | Klumpp | 33/247 |
| 5,134,798 | 8/1992 | Lee | 42/100 |
| 5,570,529 | 11/1996 | Amelino | 42/101 |
| 5,590,484 | 1/1997 | Mooney et al. | 42/100 |
| 5,787,630 | 8/1998 | Martel | 42/101 |

*Primary Examiner*—Ramon O. Ramirez
*Assistant Examiner*—Anita M. King
*Attorney, Agent, or Firm*—Michael A. Mann; Nexsen Pruet Jacobs & Pollard LLP

[57] ABSTRACT

The present invention is a T-rail that is capable of supporting, in the preferred embodiment, a day and night optical sights, image intensifier and thermal imaging device (scope) and an infrared laser designator. The scope is supported on an upper rail while the designator is supported on an extension that extends perpendicularly away from the upper rail. The T-rail supports these two objects in alignment so that when the T-rail is removed from the weapon and subsequently replaced, the two objects remain in alignment. The T-rail is designed to be mounted to a standard Picatinny rail and comprises a jaw and flange along its bottom to facilitate this mounting. The jaw has a top surface and a bottom surface that matingly engage the top and bottom slope of one side of the Picatinny rail, while the flange has only an upper surface that rests along the top slope of the other side of the rail. A clamp that engages the exposed bottom slope of the mounting rail and the body of the T-rail is used to secure and lock the T-rail in place alone the mounting rail. The attachment device, including the jaw, flange and clamp, are designed so that the T-rail may be mounted in either direction on the mounting rail. In other words, the scope and designator may be mounted for either a right handed or left handed shooter.

17 Claims, 4 Drawing Sheets

32
38
44
90
52
92
100
76
70
80
66
72
30
36
44
80
92
52
90
100

REVERSIBLE T-RAIL MOUNTABLE TO A PICATINNY RAIL

BACKGROUND OF THE INVENTION

1. Field of the Invention

The present invention relates to T-rail that can be mounted to a weapon. In particular, the present invention relates to T-rail that allows a first and second object to be mounted to a weapon while maintaining the first and second object in alignment.

2. Discussion of Background

With area fire weapons, it is sometimes necessary to equip these weapons with a day and night optical sights, image intensifier and thermal imaging device (hereinafter called the "scope"). Consequently, these weapons typically have a mounting device such as a Picatinny rail (MIL-STD-1913) so that the scope can be mounted thereon. When using the night scope, the preference is to use an infrared laser designator much like a flashlight to illuminate the targeted area or as an aiming device. However, once the scope is mounted to the weapon, there has yet to be a suitable platform to mount the designator. Furthermore, it is not practical to hold the designator by hand. In addition, it may be useful to have both a day optic scope mounted to the weapon along with a visible laser. Consequently, there is a need for a platform or attachment that may be used to support both a scope and a designator in suitable alignment.

Attempts have been made to solve the above problem by bolting an extension plate on the mounting rail. This was accomplished by drilling through the mounting rail and into the end of the plate. Screws were then inserted through the base of the rail and into the ends of the plate. Due to the wall thickness between the top and bottom of the plate and the hole for the screw, the plate failed, specifically because it is necessary for any device to be able to handle the stresses to which these weapons are typically subjected. For instance, the plate was basically a permanent attachment to the weapon, and thus was an extension of the weapon that would be knocked, hit, or damaged when the soldiers jumped or parachuted into an area or ran through woods or brush.

While it is possible to remove the scope and designator from the rail and plate, it would be necessary to realign the two each time they were replaced on the weapon. In addition, because conventional screws were needed to fasten the plate to the rail without any type of locking device, the vibrations of the weapon were likely to cause the screws to work free, thus decreasing the stability of the designator.

Consequently, there is a need for a device that will handle the stresses that are associated with this type of weapon while supporting a scope and a designator in alignment. In addition, this device should be readily removable so that when it is not needed, it can be removed from the weapon but be easily replaced when necessary.

SUMMARY OF THE INVENTION

According to its major aspects and broadly stated, the present invention is a T-rail that can be mounted to a standard mounting rail on a weapon. The T-rail has an upper Picatinny rail that extends along the top of the T-rail and an extension that extends perpendicularly therefrom. The upper rail provides a suitable mounting position for a scope, while a laser designator can be mounted to the extension.

The T-rail comprises a body with the upper rail carried thereon. The body also has an attachment device for securing the T-rail to the mounting rail. This attachment device enables the T-rail to be mounted to the mounting rail in either direction. In other words, when the T-rail with the scope and designator are mounted to a weapon, the designator may be positioned on the left side of the scope, but may also be positioned on the right side of the scope by reversing the T-rail and remounting the scope and designator to face in the forward direction.

The reversibility of the T-rail is an important feature of the present invention and is accomplished by the interaction of the attachment and securing devices. Specifically, at either end of the body and along its bottom are a jaw and a flange. The jaw is designed to matingly engage the top and bottom slope of one side of the mounting rail, while the flange rests along the top slope of the other side of the rail. A clamp that is secured into position by a screw extending through the body and a torque nut locks the clamp against the body and the bottom slope of the mounting rail, to prevent the unwanted movement of the T-rail relative to the weapon.

The fixed attachment of the extension to the body relative to the upper rail is another important feature of the present invention. The extension has a groove that extends parallel to the upper rail and provides a convenient mounting spot for an auxiliary device, such as the laser designator. The groove could also be replaced by a Picatinny rail/groove combination. When a scope is mounted to the upper rail and a designator to the extension with both aligned, it is now possible to remove the assembly and then reattach it to the same weapon or a different weapon, while the scope and designator remain in alignment. This is especially important because it is not always necessary to have the scope and designator mounted to the weapon, but the ability to attach both at the same time, knowing they are in alignment, can provide a significant savings in time.

Still another important feature of the present invention is the flexibility in mounting positions that are provided with the T-rail. For instance, the T-rail and other typical mounting rails are usually constructed from aluminum and thus are subject to scarring by scope mounts that attach the scope to a rail. Once a scope has been attached repeatedly to the same position on a rail, that position gets scarred and after time will not hold the scope in a stable position, and thereafter it will be necessary to change the position of the scope on the weapon away from the shooter's preferred position. If the T-rail scars the mounting rail, then it is possible to mount the T-rail at a different position on the mounting rail. However, the scope can be moved back to the shooter's preferred position by changing the mounting position of the scope relative to the upper rail. Therefore, with two position changes the scope position relative to the weapon has not changed, thus preserving the preferred position of the scope for the shooter. In addition, the degree of movement of the scope and T-rail can be changed numerous times in order to provide a variety of mounting positions, while the scope stays in the same position relative to the weapon.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
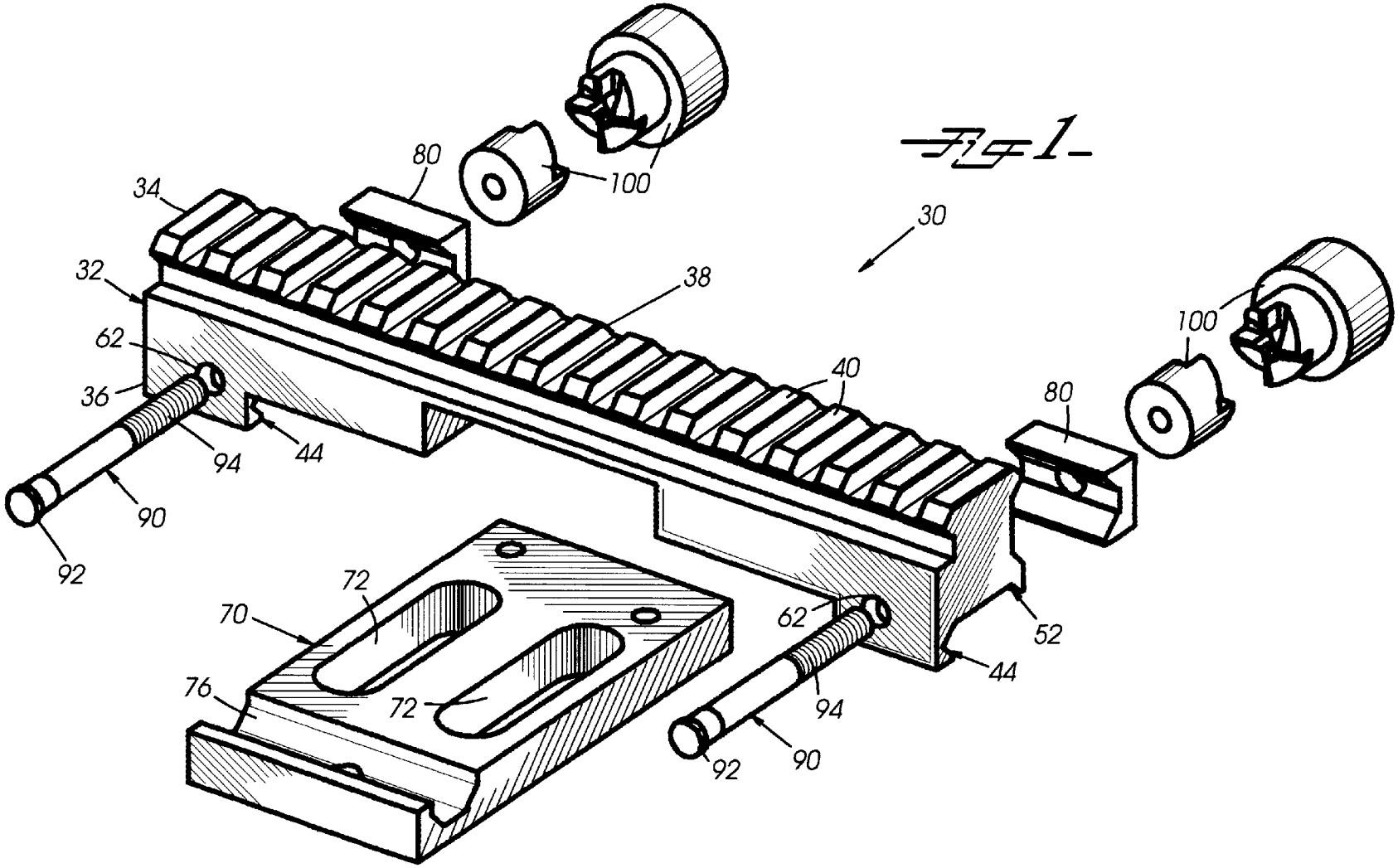
FIG. 1 is an exploded perspective view of a T-rail according to a preferred embodiment of the present invention.

Referring now to figures, a T-rail 30 is shown that is capable of being mounted to a mounting rail 10, which in the preferred embodiment is a standard military specification rail having a plurality of transverse ribs. Mounting rail 10 has a first side 12 and a second side 18, with each having a top slope 14, 20 and a bottom slope 16, 22, respectively. In addition, mounting rail 10 is typically mounted to the top of a weapon so that varying accessories, such as scopes, may be mounted thereon.

In the following description, T-rail 30 will be described as being able to support a night scope 24 and an infrared laser designator 26 in alignment. However, those of ordinary skill in the art will recognize that T-rail 30 may be adapted to support any two objects that might be necessary or desired.

T-rail 30 comprises a body 32 having a top 34 and a bottom 36 and having an extension 70 extending perpendicularly from body 32. Carried along the top 34 of body 32 and extending longitudinally thereon is an upper rail 38 that is also a standard military Picatinny rail with a plurality of equally spaced transverse ribs 40. T-rail 30 is capable of being mounted to the mounting rail 10, so that extension 70 is extending toward the first side 12 or the second side 18 of mounting rail 10. (See FIGS. 4 and 5). In other words, T-rail 30 can be mounted on the weapon so that the night scope 24 and the designator 26 are positioned for a right-handed shooter or reversed and mounted for a left-handed shooter.

Figure 4:
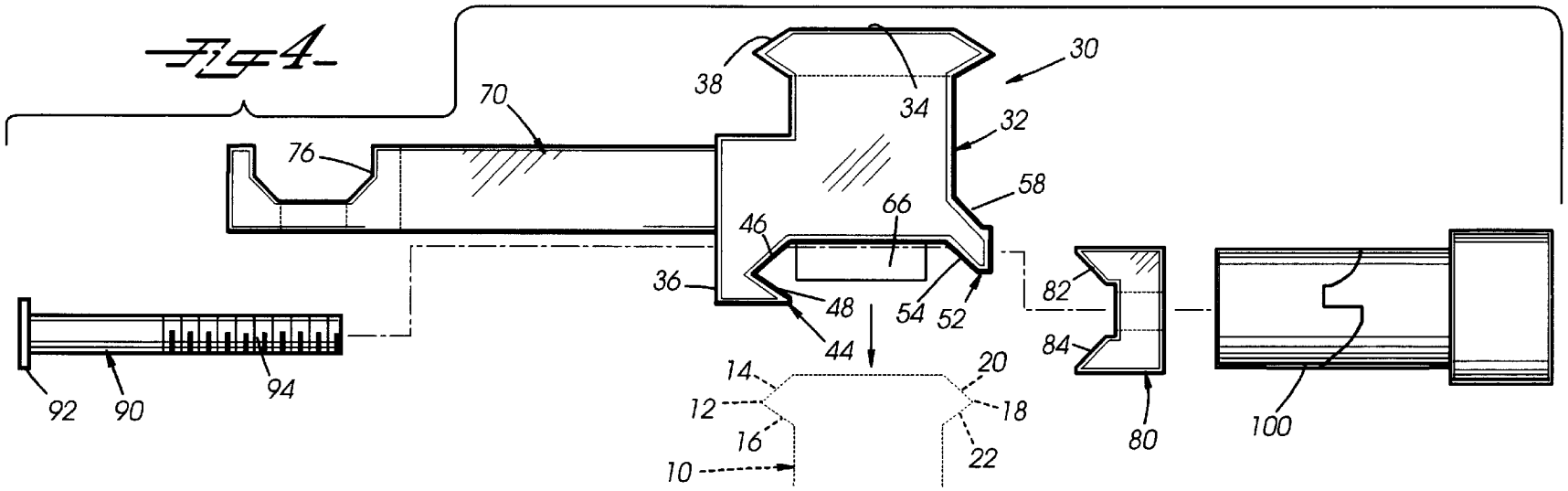
FIG. 4 is a partially exploded front view of a T-rail according to a preferred embodiment of the present invention.

T-rail 30 also comprises a jaw 44 and a flange 52 along the bottom 36 of body 32 that facilitate its mounting to the mounting rail 10. As shown in FIG. 4, jaw 44 has an upper surface 46 and a lower surface 48 that matingly engage the top slope 14 and bottom slope 16 of first side 12 of the mounting rail 10. However, flange 52 only has an upper surface 54 that rests along the top slope 20 of second side 18 of mounting rail 10 when T-rail 30 is positioned on mounting rail 10. It should be noted that jaw 44 may be positioned on either the first side 12 or the second side 18 of mounting rail 10, while flange 52 is on the opposing side, depending on the orientation of T-rail 30. (See FIG. 5.)

Figure 3:
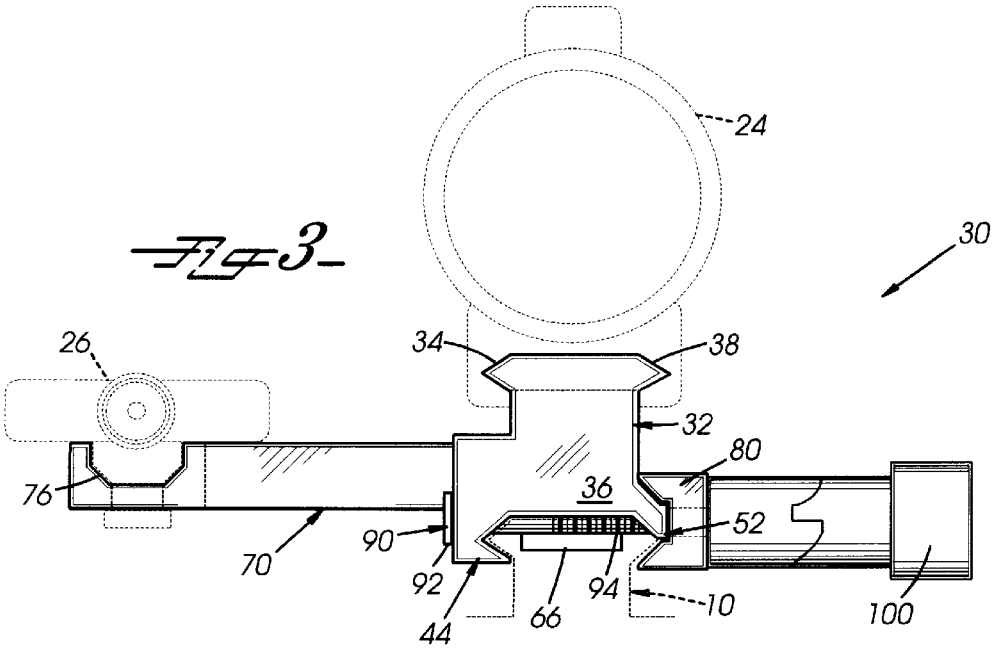
FIG. 3 is a front view of a T-rail with a scope and designator in hidden lines, according to a preferred embodiment of the present invention.

When body 32 is in position as described and shown in FIGS. 3 and 4, it may be easily removed or slid along the length of mounting rail 10 until it is secured into place. A pair of clamps 80, each held in place by a screw 90 and torque nut 100, secures body 32 to mounting rail 10 and thus T-rail 30 to the weapon. Clamp 80 has a pair of angled shoulders so that when clamp is 80 is in position, the upper shoulder 82 engages a sloped upper surface 58 on body 32, while the lower shoulder 84 engages the bottom slope 22 of mounting rail 10. Consequently, when clamp 80 is locked into place, body 32 is secured about mounting rail 10.

Figure 2:
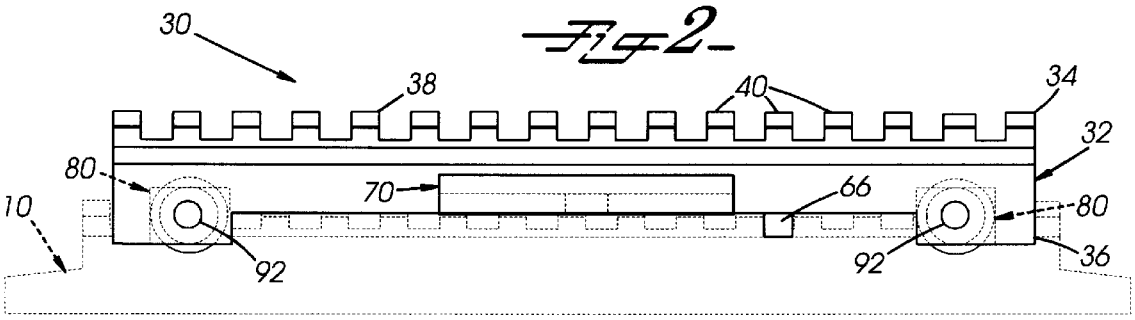
FIG. 2 is a side view of a T-rail according to a preferred embodiment of the present invention.

As shown in FIGS. 1 and 2, jaw 44 and flange 52 only extend along part of the length of body 32, preferably proximate to either end. Extending transversely through body 32, through jaw 44 and flange 52 are holes 62 which allow screw 90 to be inserted therethrough. Screw 90 has an enlarged end 92 that acts as a stop and prevents screw 90 from sliding all the way through body 32. Torque nuts 100 are attached to the threaded end 94 of screw 90, thus locking clamp 80 against body 32 and mounting rail 10 when body 32 is positioned on mounting rail 10.

Once torque nuts 100 have been attached to the threaded end 94 of screws 90, the end of screws 90 distal from its enlarged end 92 are flared, so that it is difficult to remove torque nuts 100 from screw 90. In other words, once T-rail 30 is assembled and the ends of screws 90 pinged, T-rail 30 is one complete part. Even though torque nuts 100 are attached to threaded end 94 of screws 90, torque nuts 100 may still be loosened and T-rail 30 adjusted on or removed from the mounting rail 10. It will be recognized that there are other devices that may be used to lock clamp 80 into position other than torque nuts 100 without departing from the spirit and scope of the present invention.

Extension 70 can be permanently attached to body 32 by welding both together or by casting body 32 and extension 70 as a single piece. In addition, as shown in FIG. 1, extension 70 may be removably secured to body 32 by a pair of assembly screws (not shown). Those of ordinary skill in the art will recognize that the precise method of attaching extension 70 to body 32 is not critical to the operation of T-rail 30 and is more of a manufacturing consideration than a functional consideration.

Figure 5:
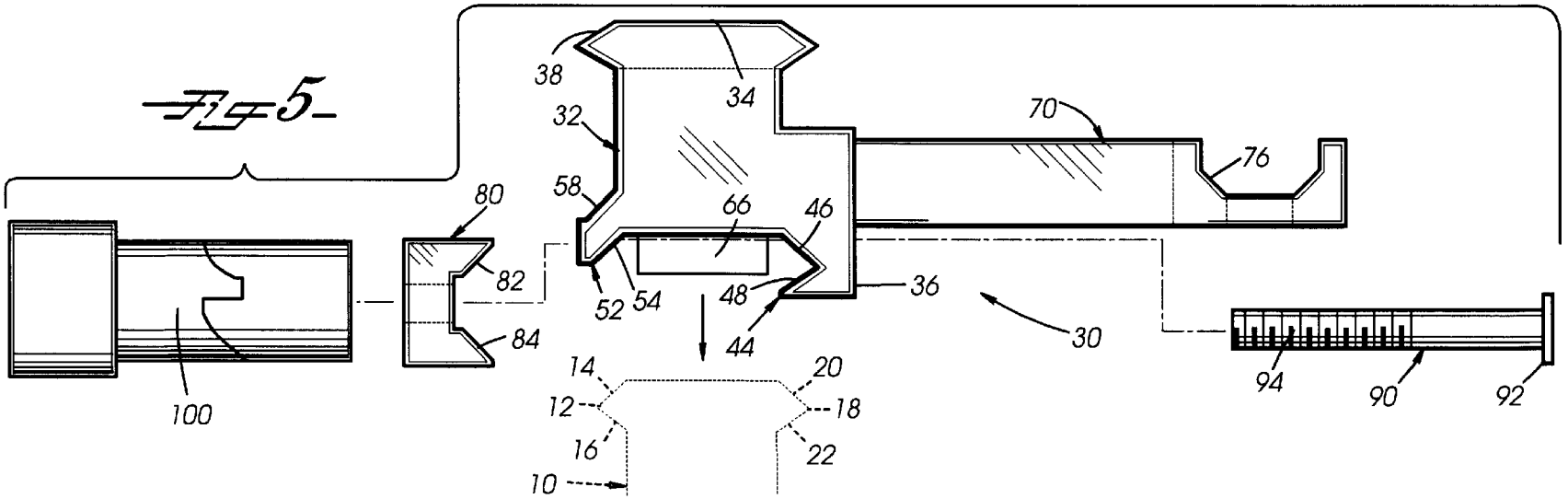
FIG. 5 is a partially exploded front view of a T-rail having been rotated 180° from that shown in FIG. 4, according to a preferred embodiment of the present invention.

Extension 70 has a groove 76 that extends approximately parallel to upper rail 38, so that in the preferred embodiment, the night scope 24 and infrared laser designator 26 may be aligned. The specific shape of groove 76 as shown in FIGS. 3–5 is designed for the infrared laser designator 26. However, it will be recognized that the shape of groove 76 is a matter of design choice for the specific object that is to be supported thereon. Therefore, T-rail 30 or extension 70 alone could be configured to support a variety of different objects merely by changing the dimensional aspects of groove 76.

Figure 6:
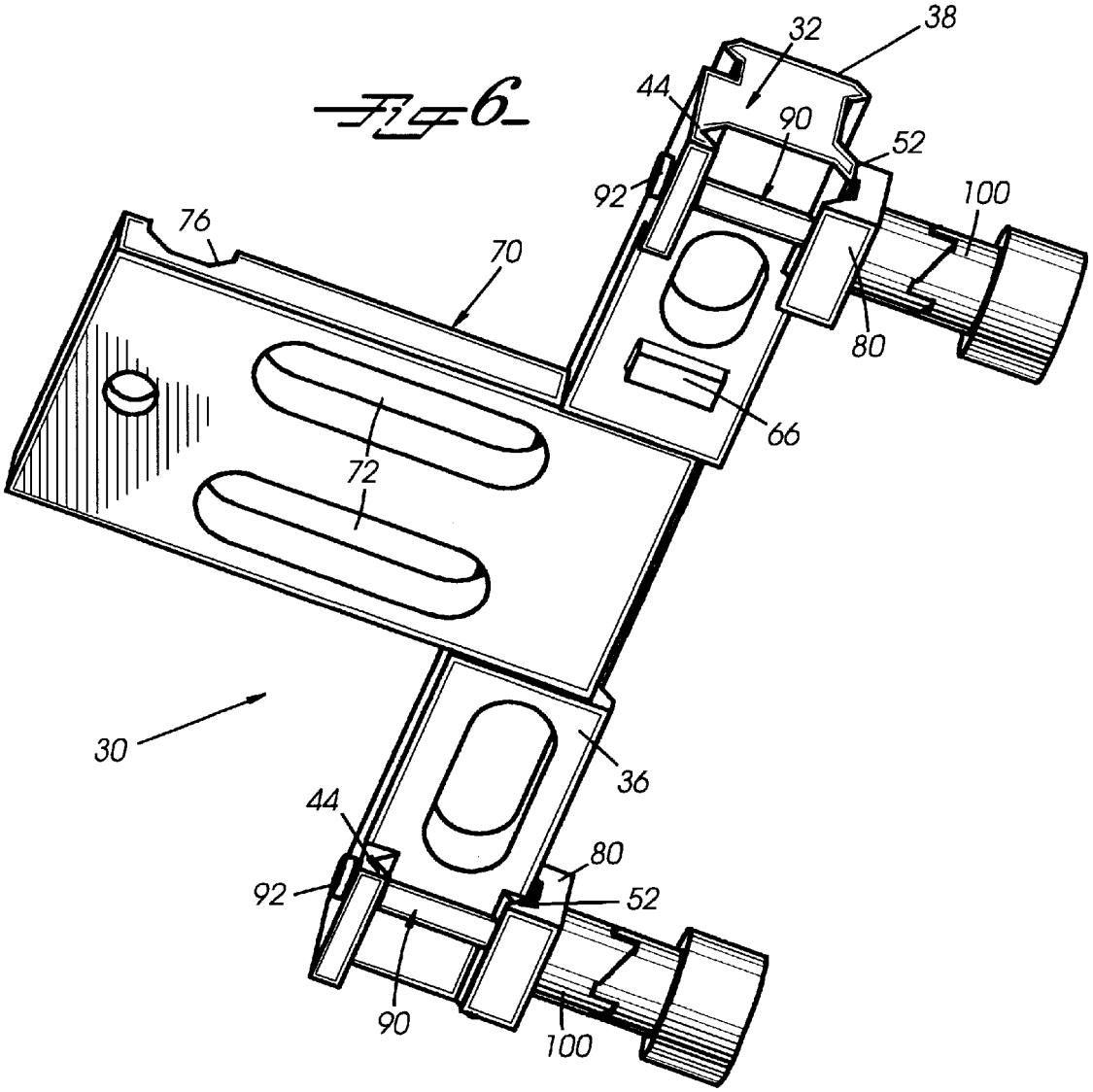
FIG. 6 is an assembled perspective view from the bottom of a T-rail according to a preferred embodiment of the present invention.

Referring specifically to FIGS. 2 and 6, a stop block 66 that is carried by bottom 36 of body 32 is shown. Stop block 66 is preferably a rectangular block extending from body 32 which engages mounting rail 10 between its transverse ribs when T-rail 30 is positioned on mounting rail 10. Stop block 66 provides a positive position for T-rail 30 and will absorb some of the stresses applied to T-rail 30. Therefore, by using stop block 66, T-rail 30 is secured into position relative to the weapon by a physical structure, as opposed to relying on the frictional interfaces between jaw 44, flange 52, clamps 80, and mounting rail 10.

T-rail 30 is designed to be used on a military weapon and thus should weigh as little as possible. Therefore, T-rail 30 is constructed from lightweight material (aluminum, titanium, etc.). In addition, extension 70 has at least one channel 72 that extends therethrough. Channel 72 is designed to reduce the weight attributed to extension 70 while not affecting the structural integrity of extension 70 or T-rail 30.

Furthermore, it is important that the dimensional interfaces of the present invention be maintained within tight tolerances. In particular, the dimensional interfaces contribute to the precision of T-rail 30 and allow it to be used with confidence and accuracy. In addition, by having the infrared laser designator 26 and scope 24 aligned on a separate mount, the T-rail 30, it is possible to have repeatability when the T-rail 30 along with the scope 24 and designator 26 are removed and replaced on the same weapon or when moved from weapon to weapon.

In another embodiment of the present invention, the T-rail 30 is designed to be mounted to an M-16 handle. Those of ordinary skill in the art will recognize that the attachment device of the present invention could be modified to grip the handle and sight groove of the M-16 without departing from the spirit and scope of the present invention. Consequently, with the modifications a scope 24 and laser designator 26 could be attached to an M-16 or any other combination of objects.

It will be apparent to those skilled in the art that many changes and substitutions can be made to the preferred embodiment herein described without departing from the spirit and scope of the present invention as defined by the appended claims.

What is claimed is:

1. A T-rail capable of being mounted to a mount on a weapon and that can support a first object and a second object, said T-rail comprising:

a body adapted to be secured to the mount, said body having means for adaptively supporting the first object; and an extension carried by said body, said extension being adapted to support the second object, said extension extending approximately perpendicularly from said body.

2. The T-rail as recited in claim 1, wherein said supporting means comprises a Picatinny rail having a plurality of transverse ribs.

3. The T-rail as recited in claim 1, wherein said body further comprises an attachment device so that said body can be reversibly mounted to said mount.

4. The T-rail as recited in claim 1, wherein the mount has a first side and a second side, said body being adapted to engage the first and second side of the mount.

5. The T-rail as recited in claim 1, further comprising means for securing said body to the mount, said securing means being adapted to engage said body and the mount.

6. A T-rail that is mountable to a mounting rail carried by a weapon, said T-rail being capable of supporting a first object and a second object, said T-rail comprising:

a body having a top and a bottom, said top having an upper rail with a plurality of transverse ribs, said rail being adapted to support the first object, said bottom of said T-rail being adapted to mount to said mounting rail;

a stop block extending from said bottom of said body and being adapted to engage the mounting rail;

means adapted to engage said body and the mounting rail for securing said body to the mounting rail; and an extension extending from said body, said extension adapted to support the second object.

7. The T-rail as recited in claim 6, wherein said bottom of said T-rail has a jaw and a flange that are adapted to matingly engage the mounting rail.

8. The T-rail as recited in claim 6, wherein said securing means comprises a clamp, said clamp being adapted to engage said body and the mounting rail when said T-rail is mounted to the mounting rail.

9. The T-rail as recited in claim 8, wherein said clamp is secured in position by a screw extending through said body and a torque nut threadably attached thereto.

10. The T-rail as recited in claim 6, wherein said extension has a groove extending approximately parallel to said upper rail, said groove adapted to support the second object.

11. The T-rail as recited in claim 6, wherein the mounting rail has a first side and a second side, each having a top and bottom slope, said bottom of said body having a jaw adapted to engage the top and bottom slope of the first side of the mounting rail, said body further comprising a flange, said flange being adapted to engage the top slope of the second side.

12. A T-rail that is mountable to a mounting rail on a weapon, said mounting rail having a first side and a second side, each side having a top and bottom slope, said T-rail being adapted to support a night scope and an infrared laser designator, said T-rail comprising:

a body having a top and a bottom, said top of said body carrying a Picatinny rail having a plurality of transverse ribs, said Picatinny rail being adapted to support the night scope, said bottom of said body having a jaw and a flange; said jaw being adapted to engage the top slope and the bottom of the first side of the mounting rail, and said flange being adapted to engage the top slope of the second side when said body is mounted on the mounting rail;

means for securing said body to the mounting rail; and an extension extending from said body, said extension having a groove therein, said groove being adapted to support the infrared laser designator, said extension having at least one channel cut therein.

13. The T-rail as recited in claim 12, wherein said jaw is capable of engaging the top slope and the bottom slope of the second side, and said flange is capable of engaging the top slope of the first side when said body is mounted to the mounting rail.

14. The T-rail as recited in claim 12, wherein said body has a transverse hole extending therethrough, and said securing means comprises:

a screw capable of extending through said hole;

a clamp; and a torque nut for locking said clamp against said body and the mounting rail.

15. The T-rail as recited in claim 14, wherein said body has a sloped upper surface positioned above said flange, said clamp having an upper shoulder and a lower shoulder, said upper shoulder engaging said sloped upper surface of said body, and said lower shoulder being adapted to engage the bottom slope of the second side of the mounting rail when said body is mounted to said mounting rail.

16. The T-rail as recited in claim 12, wherein said extension is removably attached to said body.

17. The T-rail as recited in claim 12, wherein said securing means comprises a clamp, said clamp engaging said body and being adapted to engage the bottom slope of the second side of the mounting rail when said body is mounted on the mounting rail.

* * * * *